US008152020B2

(12) United States Patent
Flowers et al.

(10) Patent No.: US 8,152,020 B2
(45) Date of Patent: Apr. 10, 2012

(54) DOSAGE DISPENSING AND TRACKING CONTAINER

(76) Inventors: Mary E. Flowers, Sneads, FL (US); Arnett G. Flowers, Panama City, FL (US)

( * ) Notice: Subject to any disclaimer, the term of this patent is extended or adjusted under 35 U.S.C. 154(b) by 788 days.

(21) Appl. No.: 12/217,892

(22) Filed: Jul. 9, 2008

(65) Prior Publication Data

US 2010/0006585 A1 Jan. 14, 2010

(51) Int. Cl.
*B65H 3/00* (2006.01)
*G07F 11/62* (2006.01)

(52) U.S. Cl. ..... 221/5; 221/4; 221/8; 221/7; 221/2

(58) Field of Classification Search ..... 221/2, 4, 221/5, 7, 8, 121, 113; 700/242–243
See application file for complete search history.

(56) References Cited

U.S. PATENT DOCUMENTS 3,477,561 A * 11/1969 Martin ..... 206/536
4,117,952 A * 10/1978 Grimes ..... 221/5
4,572,403 A * 2/1986 Benaroya ..... 221/3
4,748,600 A 5/1988 Urquhart
5,322,166 A * 6/1994 Crowther ..... 206/538
5,392,952 A * 2/1995 Bowden ..... 221/15
5,762,199 A * 6/1998 Aguilera ..... 206/533
6,145,697 A * 11/2000 Gudish ..... 221/3
6,415,202 B1 7/2002 Halfacre
6,510,962 B1 1/2003 Lim
6,574,165 B2 * 6/2003 Sharma et al. ..... 368/10
6,667,936 B1 12/2003 Ditzig
6,988,634 B2 * 1/2006 Varis ..... 221/7
7,044,302 B2 5/2006 Conley
7,100,793 B2 * 9/2006 Baum ..... 221/15
7,240,795 B2 * 7/2007 Lee ..... 206/539
7,302,311 B2 11/2007 Varis
2005/0178779 A1 * 8/2005 Wood ..... 221/7
2006/0124658 A1 * 6/2006 Coe et al. ..... 221/121
2006/0163267 A1 * 7/2006 Lapsker ..... 221/2
2007/0012712 A1 * 1/2007 Syiau ..... 221/2
2008/0203107 A1 * 8/2008 Conley et al. ..... 221/1

* cited by examiner

*Primary Examiner* — Michael K Collins
(74) *Attorney, Agent, or Firm* — J. Wiley Horton

(57) ABSTRACT

A container for dispensing dosages of multiple medications over time. The present invention includes a container which has a plurality of compartments each configured to contain a plurality of dosages of a different medication. A rotatable lid is attached on top of the container such that an opening in the lid may be selectively positioned in fluid communication with each of the plurality of compartments. A lid position detection device is provided for identifying which of the compartments the opening is presently addressing. A programmable computing device is provided to track dosages administered from each of the plurality of compartments. A display, controlled by the programmable computing device, conveys information regarding the medication contained within a selected compartment.

17 Claims, 12 Drawing Sheets

DOSAGE DISPENSING AND TRACKING CONTAINER

BACKGROUND OF THE INVENTION

1. Field of the Invention

This invention relates to the field of medication containers and dispensers. More specifically, the present invention comprises a container for dispensing dosages of multiple medications and tracking dosages dispensed from the container.

2. Description of the Related Art

Various containers are available for containing and dispensing medications. Most containers are designed to contain individual dosages in separate compartments. The most common versions of these containers utilize separate compartments to separate the dosages by the day of the week the each dosage is to be administered. Each compartment is large enough to contain a daily dosage of one or more medications. In some cases, separate compartments are provided for morning dosages and afternoon dosages. In each of these cases, however, the user is first required to aliquot the medication from a first container into the individual compartments of the dosing container.

Dosing containers that separate dosages based on the time the dosage is to be dispensed are not space efficient. These containers typically occupy counter space in a user's kitchen or space on a bedside table. Although these containers are portable, they are inconvenient for carrying on a daily basis. When transported in a backpack or purse, the individual compartments can easily open, spilling the contents into the backpack or purse. These dosing containers also occupy a significant amount of space, adding significant bulk to the backpack or purse.

As such, it would be desirable to provide a space efficient and easy to use container which is capable of containing and dispensing dosages of multiple medications. It would be further desirable to provide a medication dispensing container which can track dosages dispensed from the container and provide information to the user about when future dosages are to be consumed.

BRIEF SUMMARY OF THE INVENTION

The present invention is a container for dispensing dosages of multiple medications over time. The present invention includes a container which has a plurality of compartments each configured to contain a plurality of dosages of a different medication. A rotatable lid is attached on top of the container such that an opening in the lid may be selectively positioned in fluid communication with each of the plurality of compartments. A lid position detection device is provided for identifying which of the compartments the opening is presently addressing. A programmable computing device is provided to track dosages administered from each of the plurality of compartments. A display, controlled by the programmable computing device, conveys information regarding the medication contained within a selected compartment.

In the preferred embodiment, the lid position detection device comprises a pair of position contacts which rotate with the lid and a stationary circuit configured to offer a varying resistance depending upon where the position contacts contact the circuit. This feature allows for the programmable computing device to know the present location of the opening in the lid relative to each of the storage compartments of the container.

The programmable computing device is programmed to know the dosage schedule for each medication contained within each compartment of the container. A push button is provided for allowing the user to input when a dosage is administered. The programmable computing device has an integrated timer and tracks when the user inputs that a dosage was administered. Because the lid position detection device identifies which compartment the opening in the lid is presently addressing when the user presses the button, the programmable computing device knows which medication was dispensed and is able to track dosages administered from each compartment.

The medication dispensing container is thus able to be configured to perform various notification functions. For example, the dispensing container may emit an audible alarm or provide a visual notification when it is time to administer a particular medication. The medication dispensing container may also display information regarding when and how many previous dosages were administered and how many dosages are remaining for the day or when a prescription needs to be refilled.

REFERENCE NUMERALS IN THE DRAWINGS

| | | | |
|---|---|---|---|
| 10 | dispensing container | 12 | bottle |
| 14 | lid | 16 | button |
| 18 | button | 20 | display |
| 22 | cap | 24 | data port |
| 26 | opening | 28 | compartments |
| 30 | grounding pivot | 32 | embedded circuit |
| 34 | terminals | 36 | resistors |
| 38 | ground | 40 | terminal |
| 42 | pivot wafer | 44 | slit |
| 46 | port | | |
| 50 | speaker | 52 | contact pins |
| 54 | display opening | 56 | display cover |
| 58 | display unit | 60 | ground contact |
| 62 | flange | | |

DETAILED DESCRIPTION OF THE INVENTION

Figure 1:
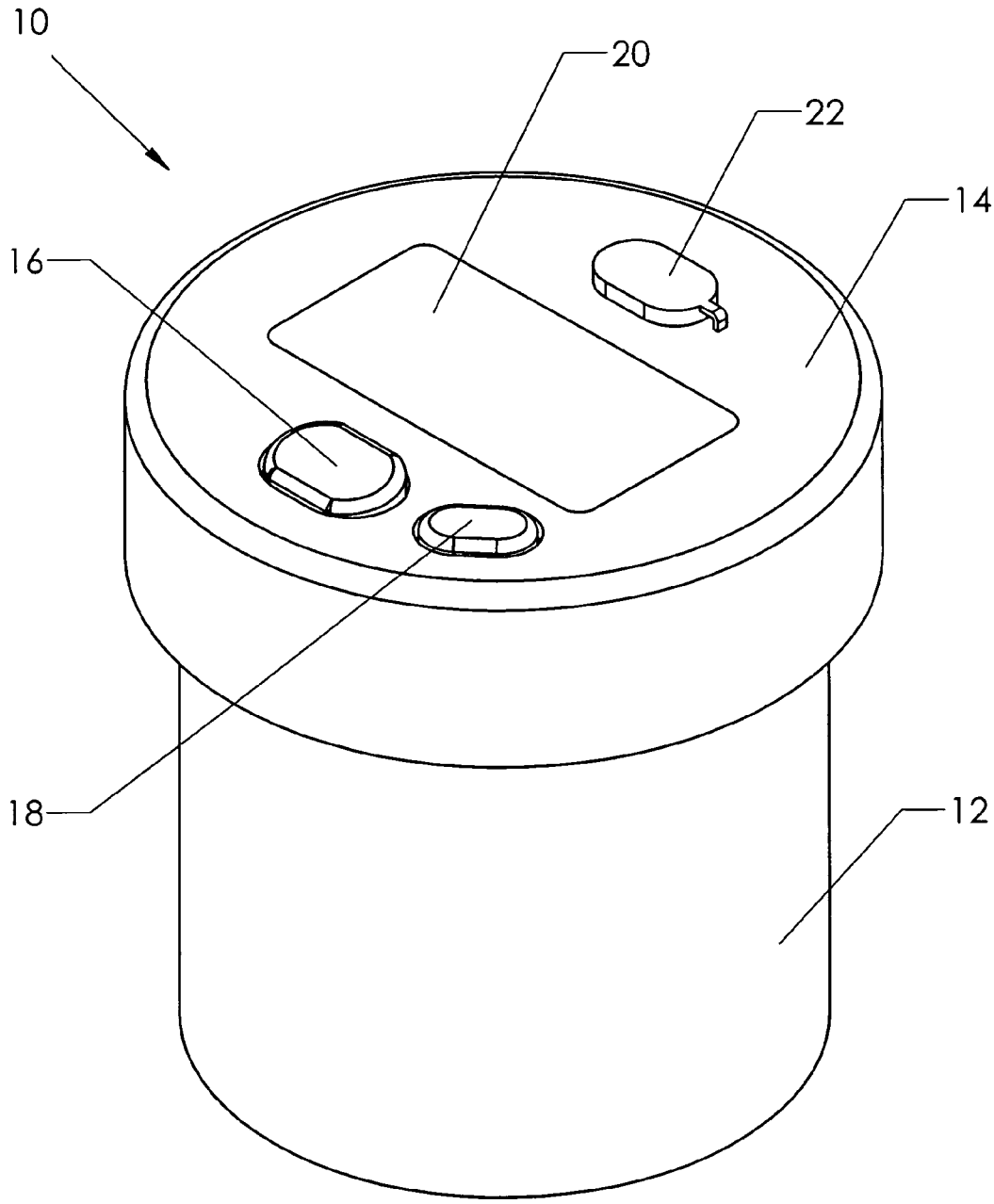
FIG. 1 is a perspective view, illustrating the present invention.

The present invention, dispensing container 10, is illustrated in FIG. 1. Dispensing container 10 may be used dispensing dosages of multiple medications over time. In the preferred embodiment, dispensing container 10 is configured to dispense six different medications and contain enough dosages of each medication to last the user at least one week. It should be noted, that dispensing container 10 may be just as easily configured to dispense more or fewer medications as may be required by an individual consumer.

Dispensing container 10 includes lid 14 which is attached to bottle 12. Lid 14 is configured to rotate angularly on top of bottle 12 for reasons that will be described in greater detail subsequently. Display 20 is viewable in the center of lid 14. Buttons 16 and 18 are provided for interacting with the internal computer which is contained within lid 14.

Figure 2:
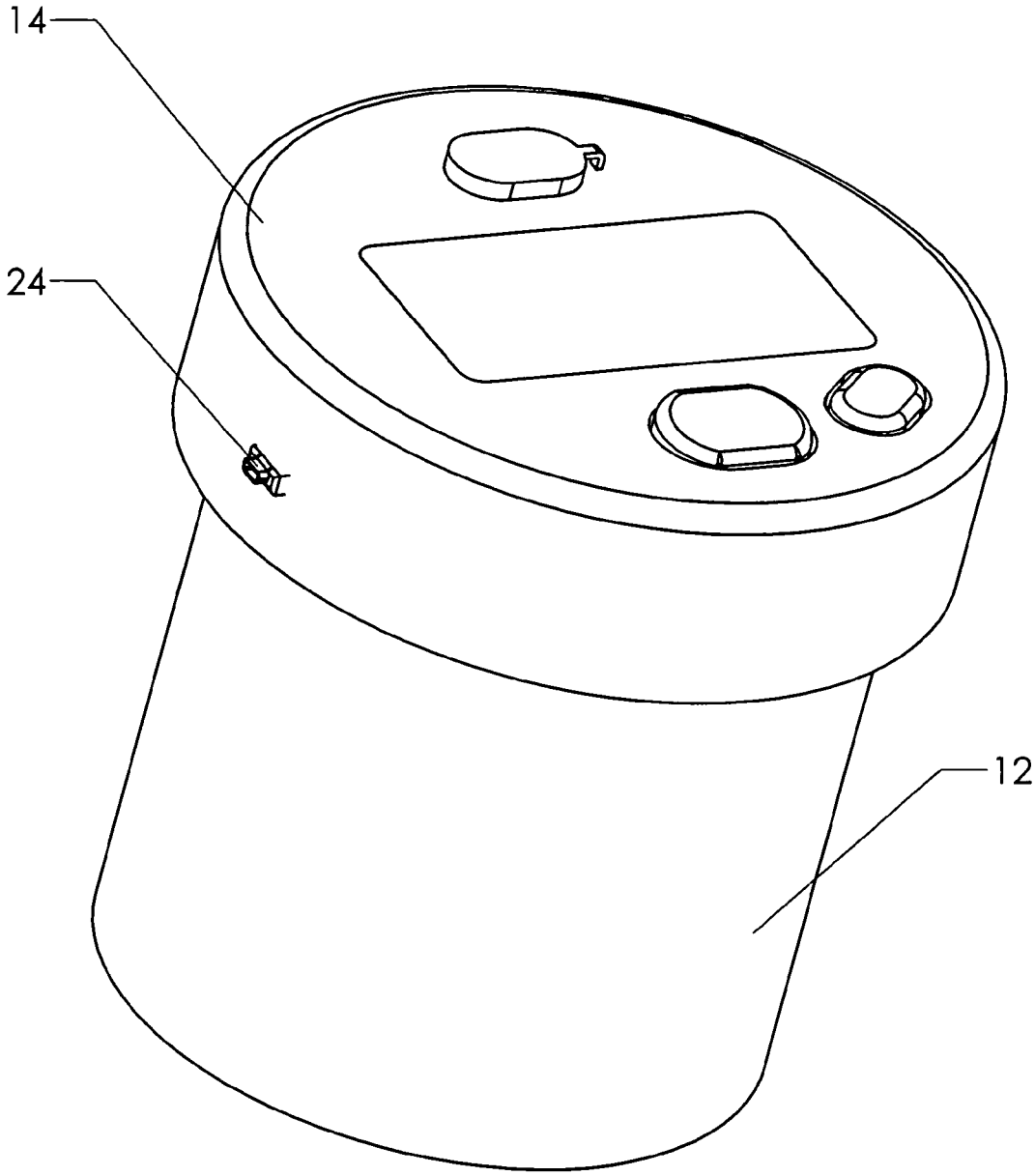
FIG. 2 is a perspective view, illustrating the present invention.

Turning to FIG. 2, the reader will note that data port 24 is provided on the side of lid 14. Data port 24 is an input/output port which allows the internal computer to interface with another computing device such as a programming computer. Data port 24 may also be used to charge an internal battery.

Figure 3:
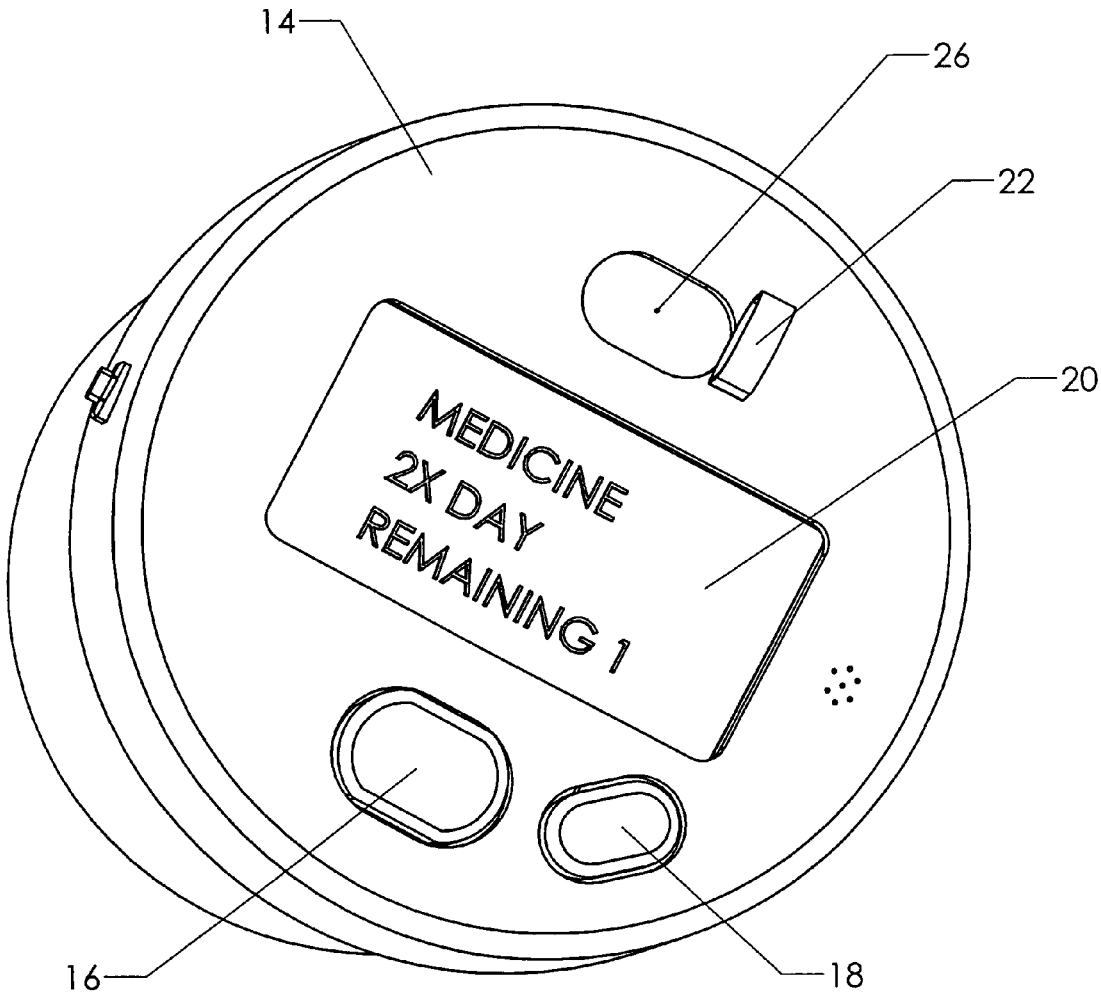
FIG. 3 is a perspective view, illustrating the present invention.

FIG. 3 illustrates lid 14 with cap 22 removed to expose opening 26. When removed as shown, opening 26 is fluidly connected with one of the storage compartments of bottle 12. The user simply inverts dispensing container 10 to pour out a dosage of the medication contained in the compartment. Although a removable cap is employed in the presently illustrated embodiment, it should be noted that other devices may be used to open and close opening 26. For example, a mechanically actuated shutter may be used to open and close opening 26.

Display 20 provides dosage information regarding one of the medications contained within dispensing container 10. In general, display 20 displays dosage information regarding the medication contained in the compartment opening 26 is presently addressing. A lid position detection device is provided for identifying which of the compartments the opening is presently addressing. In the current example, display 20 displays the name of the medication ("Medicine A"), the quantity of dosages to be taken daily (two times daily), and the quantity of dosages remaining for the day (one).

One or buttons may be provided for inputting information into the internal computer. In the present example, button 16 is used to turn on and off display 20. In another embodiment, display 20 may be configured to turn on or off automatically when lid 14 is rotated to a new position. Button 18 is used to input when a dosage has been taken. If a mechanical shutter is used to open opening 26, button 18 may also be used to open the shutter to dispense the dosage of medication. Because the lid position detection device "knows" the current position of opening 26 relative to the compartments of bottle 12, the internal computer "knows" which medication has been dispensed when button 18 is pressed and can track the dosages, comparing the dispensed dosages with a programmed dosing schedule.

Figure 4:
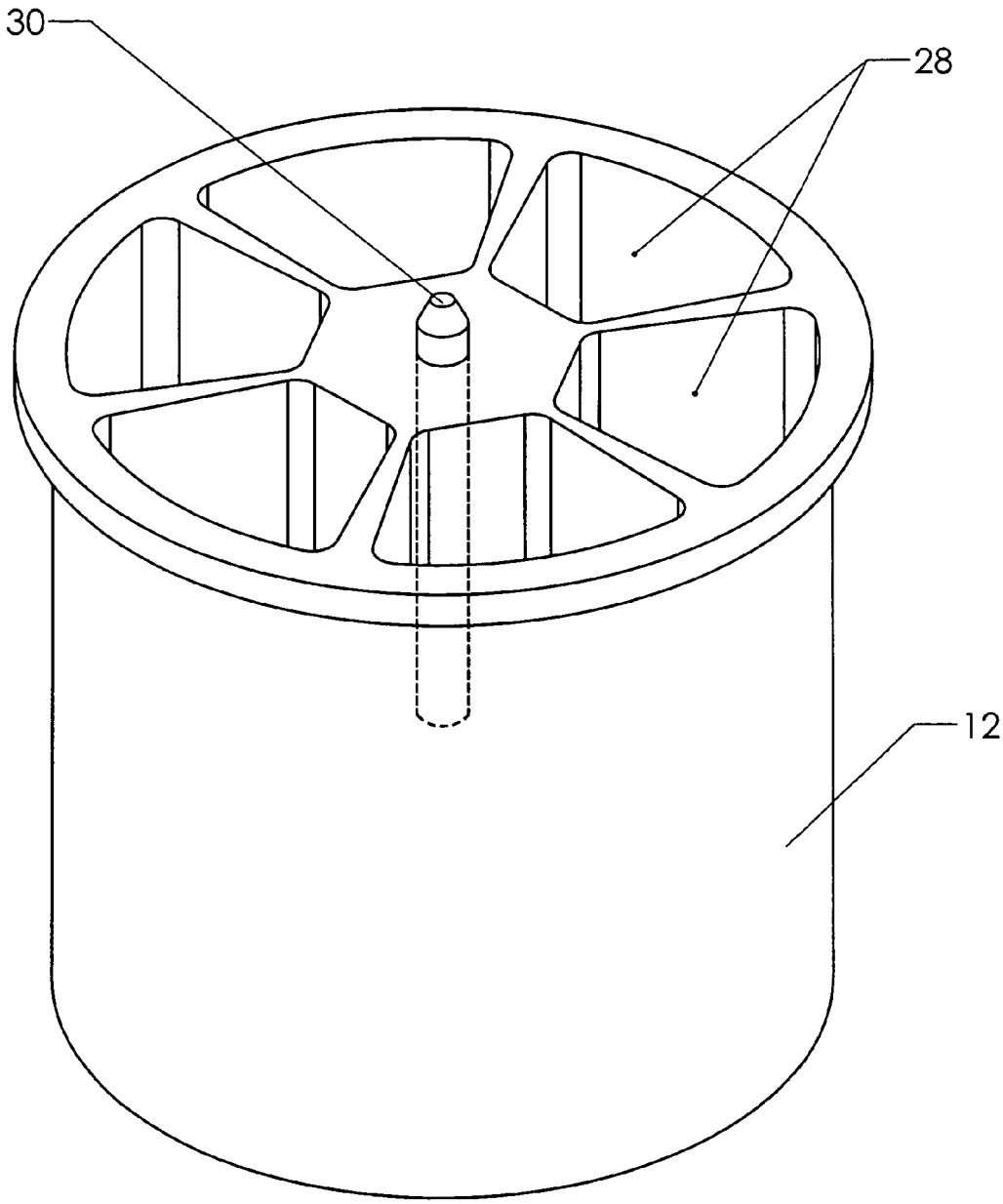
FIG. 4 is a perspective view, illustrating components of the present invention.

FIGS. 4 through 9 illustrate dispensing container 10 in various stages of assembly. FIG. 4 illustrates bottle 12 in greater detail. Bottle 12 includes a plurality of compartments 28. In the present example a total of six compartments are provided for dispensing six different medications. Each medication is deposited in one of compartments 28. Although six compartments are shown, any number of compartments could be provided. Grounding pivot 30 is provided in the center of bottle 12 at the top. Grounding pivot 30 defines a center axis of rotation for lid 14 and an electrical "ground" connection for the lid position detection device.

Figure 5:
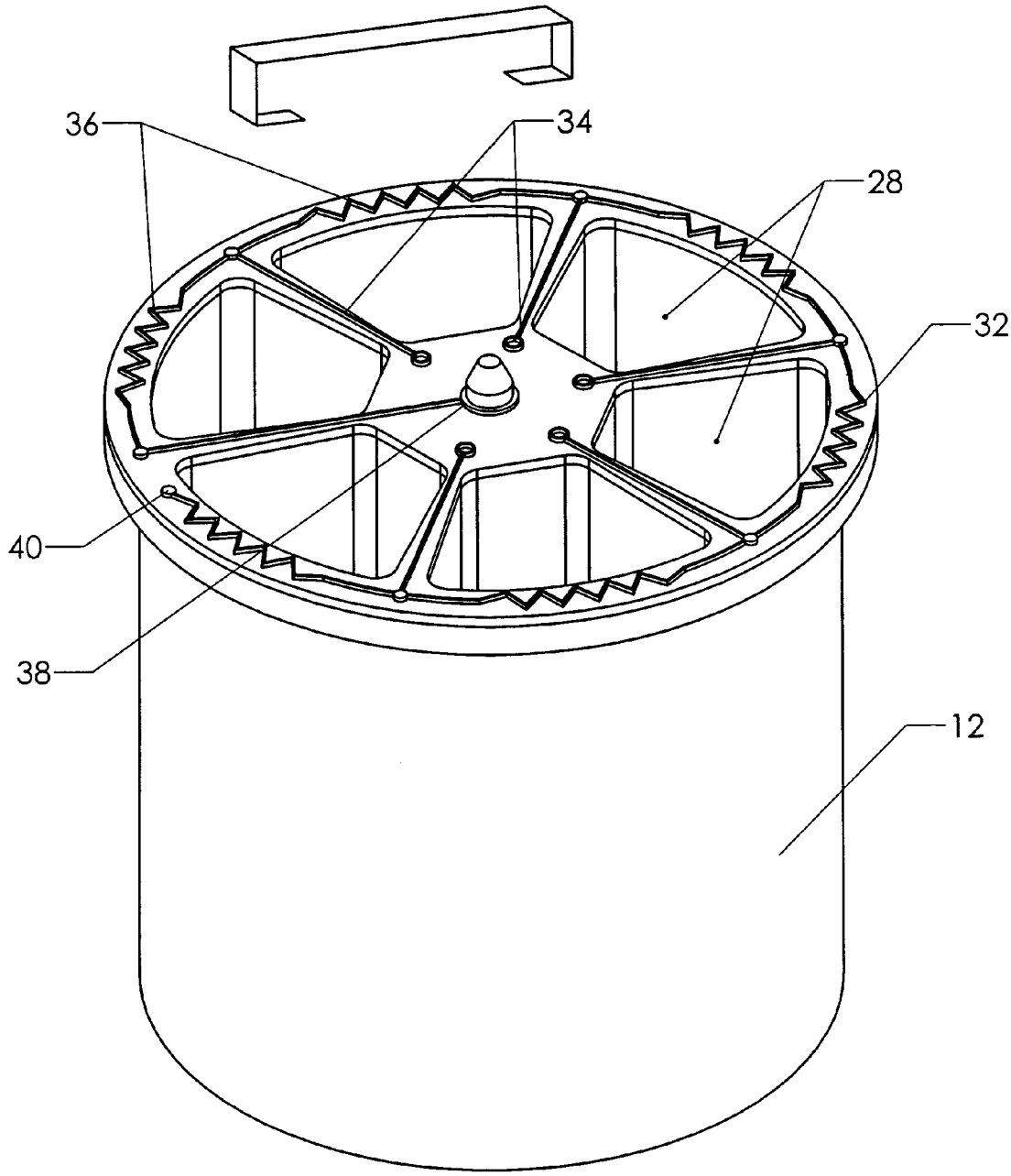
FIG. 5 is a perspective view, illustrating components of the present invention.

FIG. 5 illustrates an embedded circuit used as part of the lid position detection device. Embedded circuit 32 is attached to the top of bottle 12. Embedded circuit 32 is a rheostat type circuit configured to offer a varying resistance depending upon where the contact pins of the lid position detection device contact the circuit. Terminals 34 extend in a radial direction along the top of the walls separating compartments 28. Resistors 36 extend around the perimeter of the bottle between each terminal 28. The reader will note that final terminal 40 is connected to ground 38 through six resistors in the present embodiment. Terminals 34 provide a contact surface for the contact pins of the lid position detection device. Those that are skilled in the art will appreciate that embedded circuit 32 is configured to provide a varying resistance to current flow depending upon which two adjacent terminals 34 are contacted by the lid position detection device.

Figure 6:
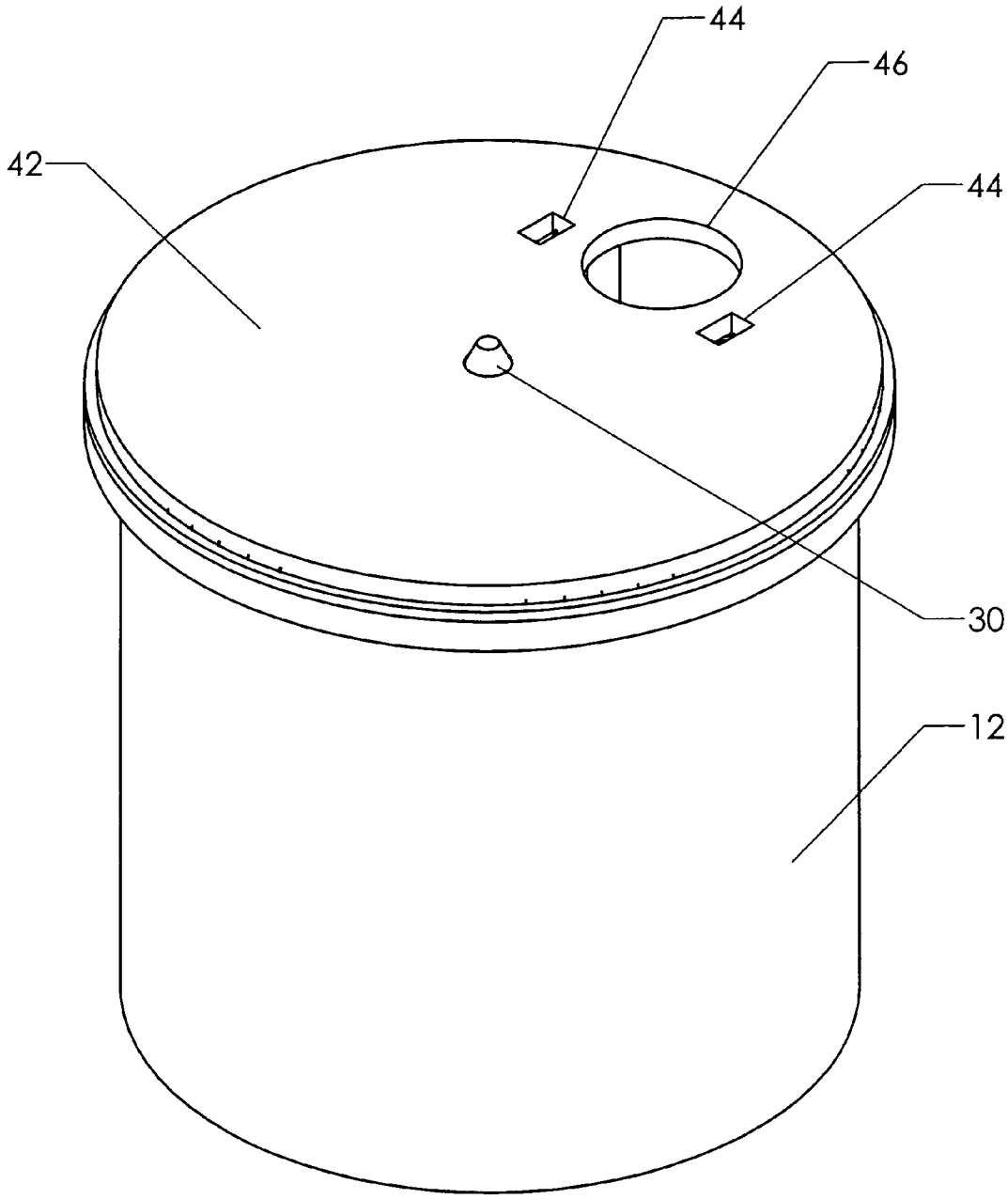
FIG. 6 is a perspective view, illustrating components of the present invention.

As shown in FIG. 6, pivot wafer 42 rests on top of the embedded circuit and rotated angularly about grounding pivot 30. Pivot wafer 42 covers the individual storage compartments to prevent unwanted contaminants (such as moisture, dust and dirt) from entering the storage compartments. Pivot wafer 42 also prevents the contaminants from contacting the electronics. Port 46 passes through pivot wafer 42, allowing dosages to be dispensed from a selected storage compartment. Slits 44 lie on either side of port 46. Slits 44 are located and dimensioned such that adjacent terminals 34 are visible through slits 44 when port 46 is positioned above one of the storage compartments.

Figure 7A:
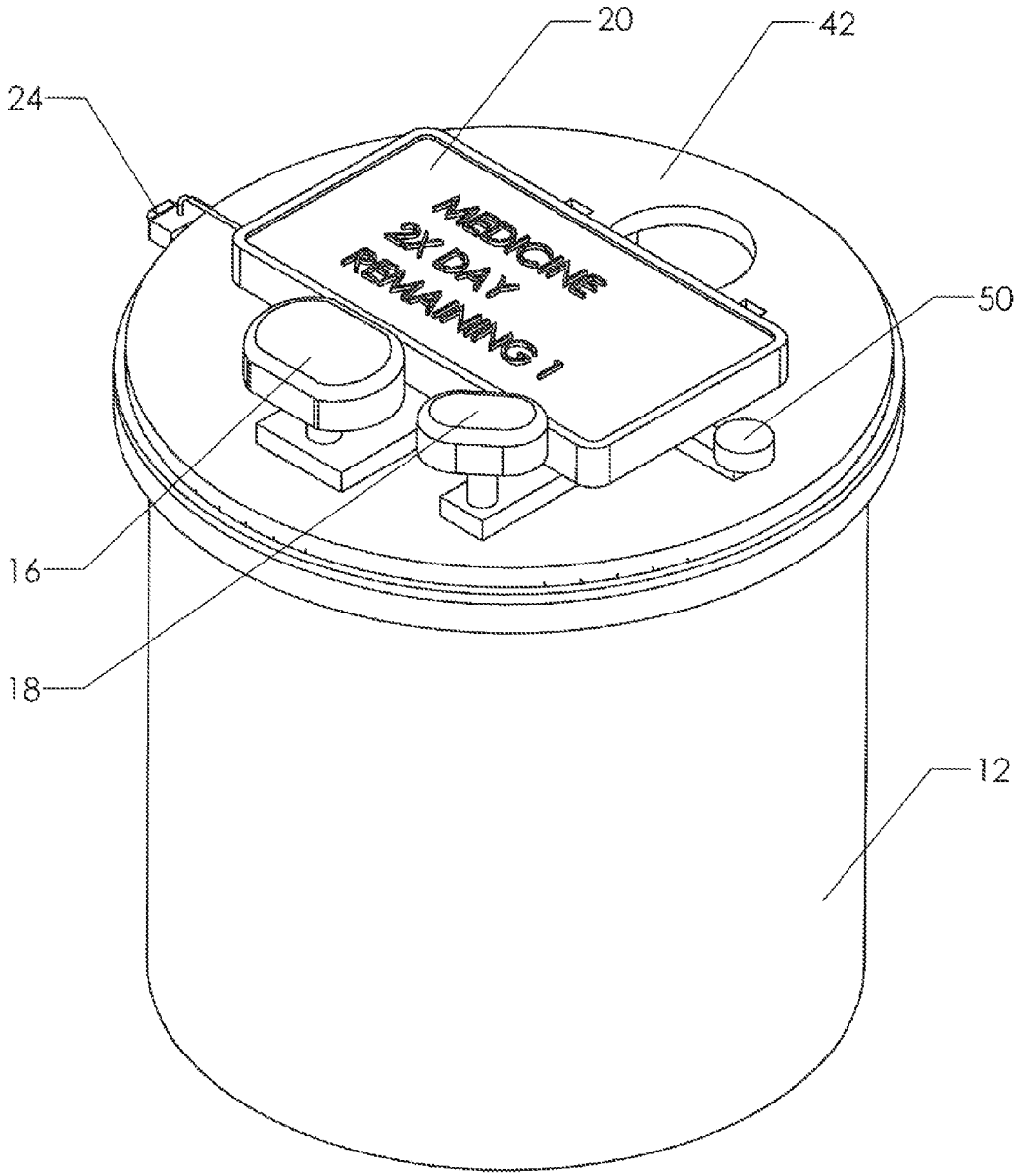
FIG. 7A is a perspective view, illustrating components of the present invention.
Figure 7B:
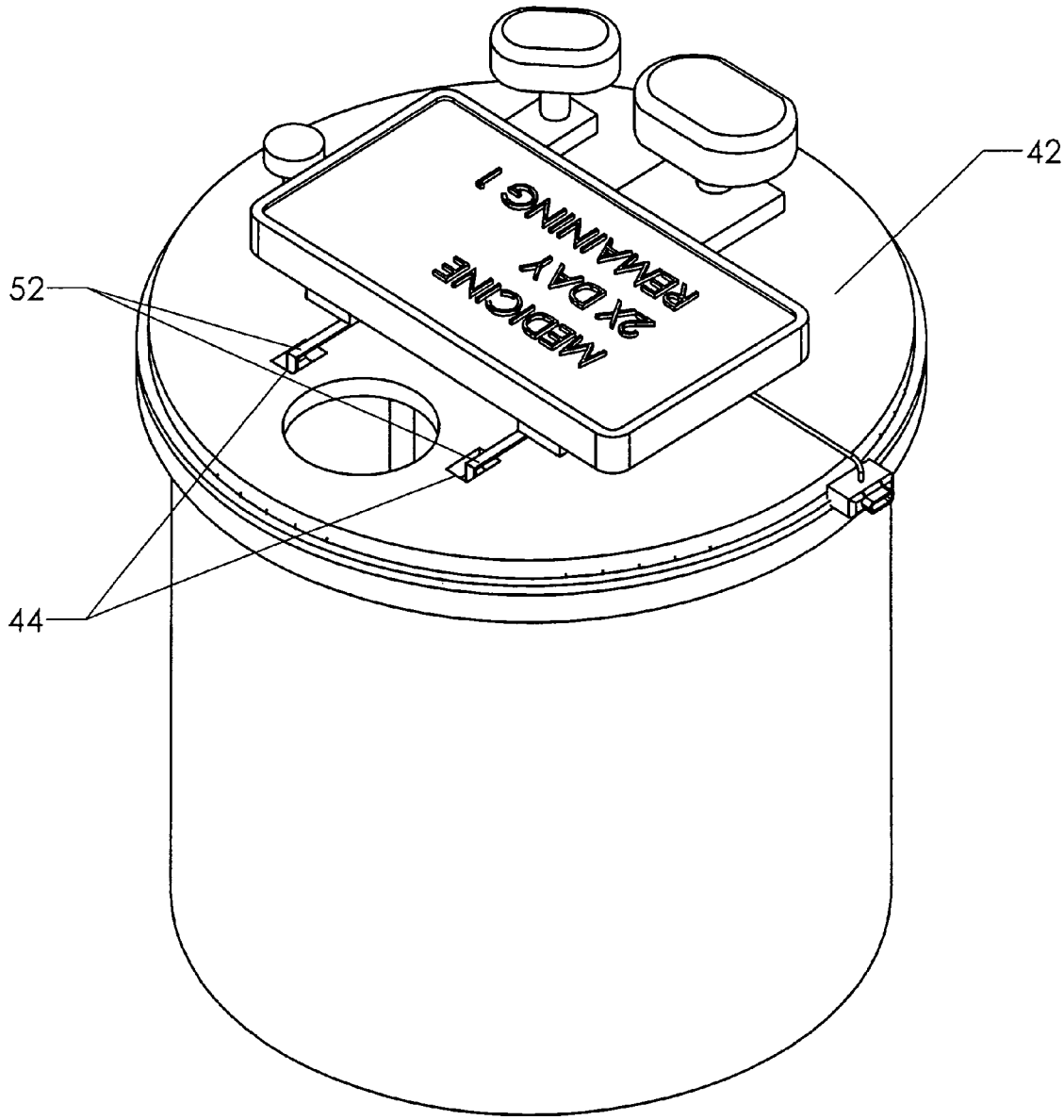
FIG. 7B is a perspective view, illustrating components of the present invention.

As shown in FIGS. 7A and 7B, the display unit lies on the opposite side of pivot wafer relative to the storage compartments of bottle 12. The term "display unit" as used herein refers collectively to the electronic components of the presently illustrated embodiment, including display 20, data port 24, speaker 50, contact pins 52, the integrated programmable computing device, the internal battery, buttons 16 and 18, and the electrical conductors connecting each of the aforementioned components. The integrated programmable computer device receives inputs from data port 24, buttons 16 and 18, and contact pins 52. The integrated programmable computer device outputs to display 20 and speaker 50. The integrated programmable device includes an internal clock or timer and notifies the user by audible alarm through speaker 40 or visible notification from display 20 (or additional LED) when a dosage is to be administered. Speaker 50 may optionally be used to play a recorded message regarding the medication or dosage instructions.

As shown most clearly in FIG. 7B, contact pins 52 extend outwardly from the display unit and pass through slits 44 in pivot wafer 42 where they contact two adjacent terminals 34 of embedded circuit 32. The internal programmable computer is able to discern the position of contact pins 52 (and thus lid 14) based upon the amount of resistance offered by embedded circuit 32.

Figure 8:
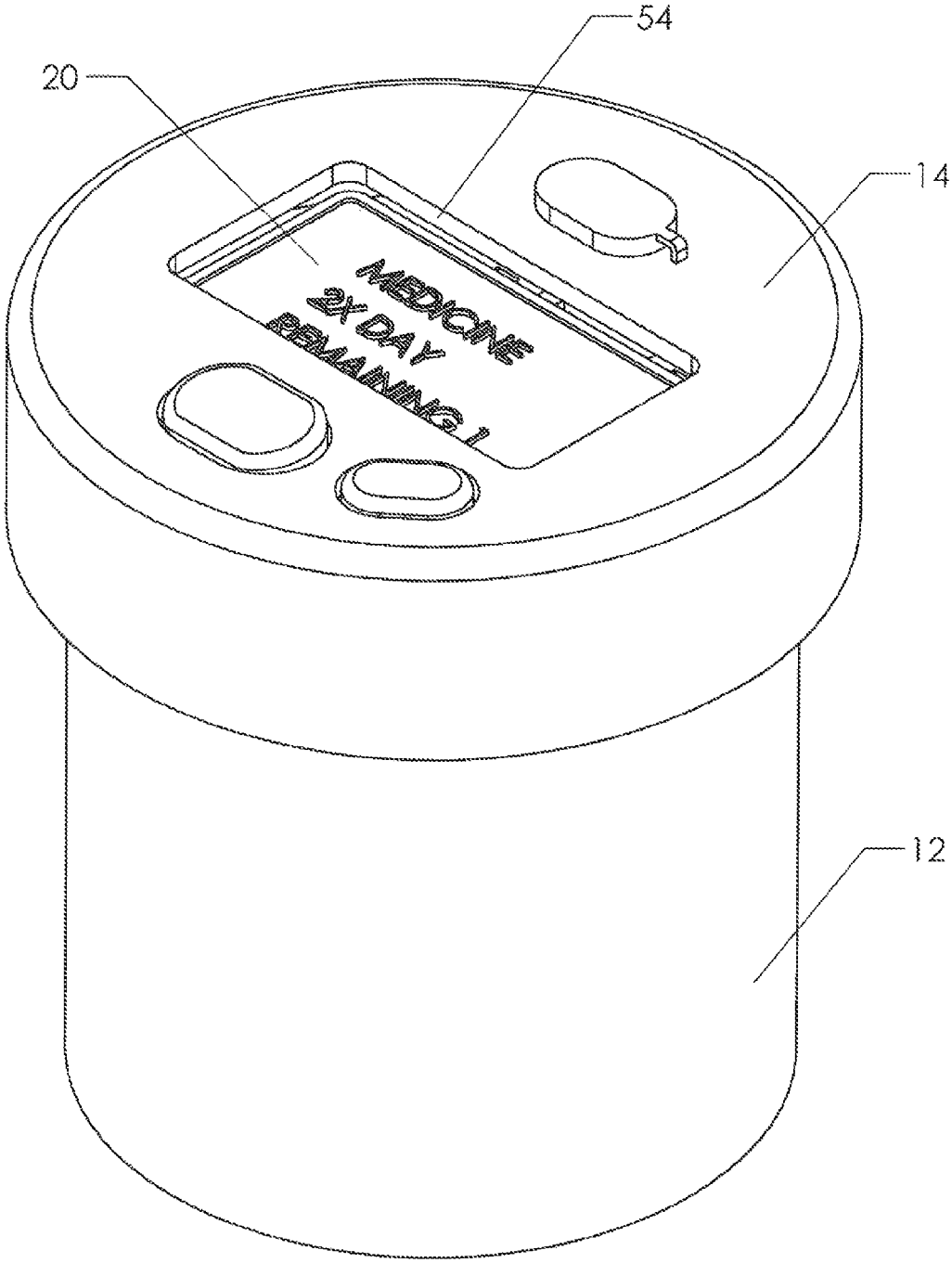
FIG. 8 is a perspective view, illustrating components of the present invention.
Figure 9:
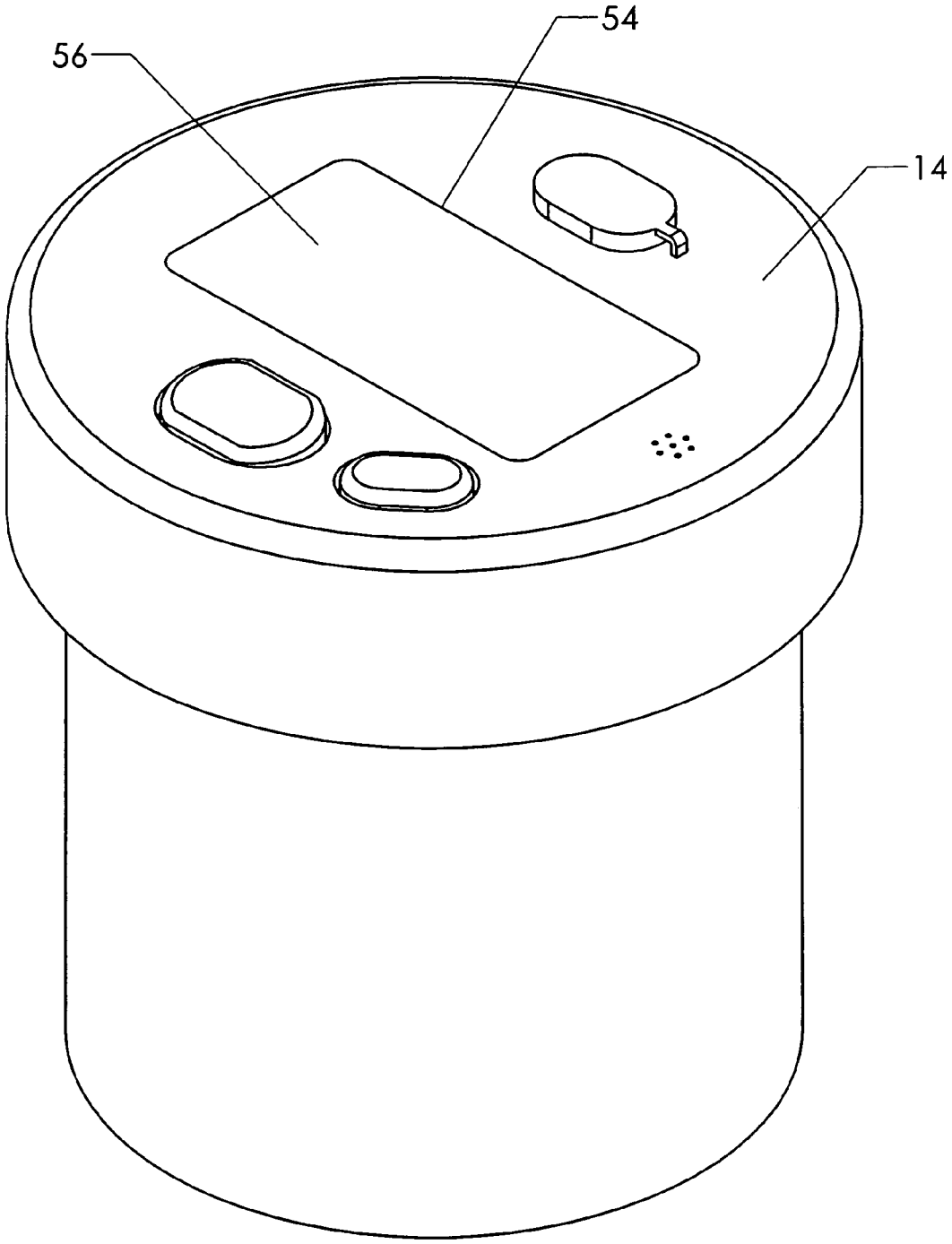
FIG. 9 is a perspective view, illustrating components of the present invention.

Turning to FIG. 8, lid 14 is shown attached to the top of bottle 12. Display 20 is visible through display opening 54 of lid 14. As shown in FIG. 9, glass display cover 56 may be provided in display opening 54 to prevent display 20 from being damaged.

Figure 10:
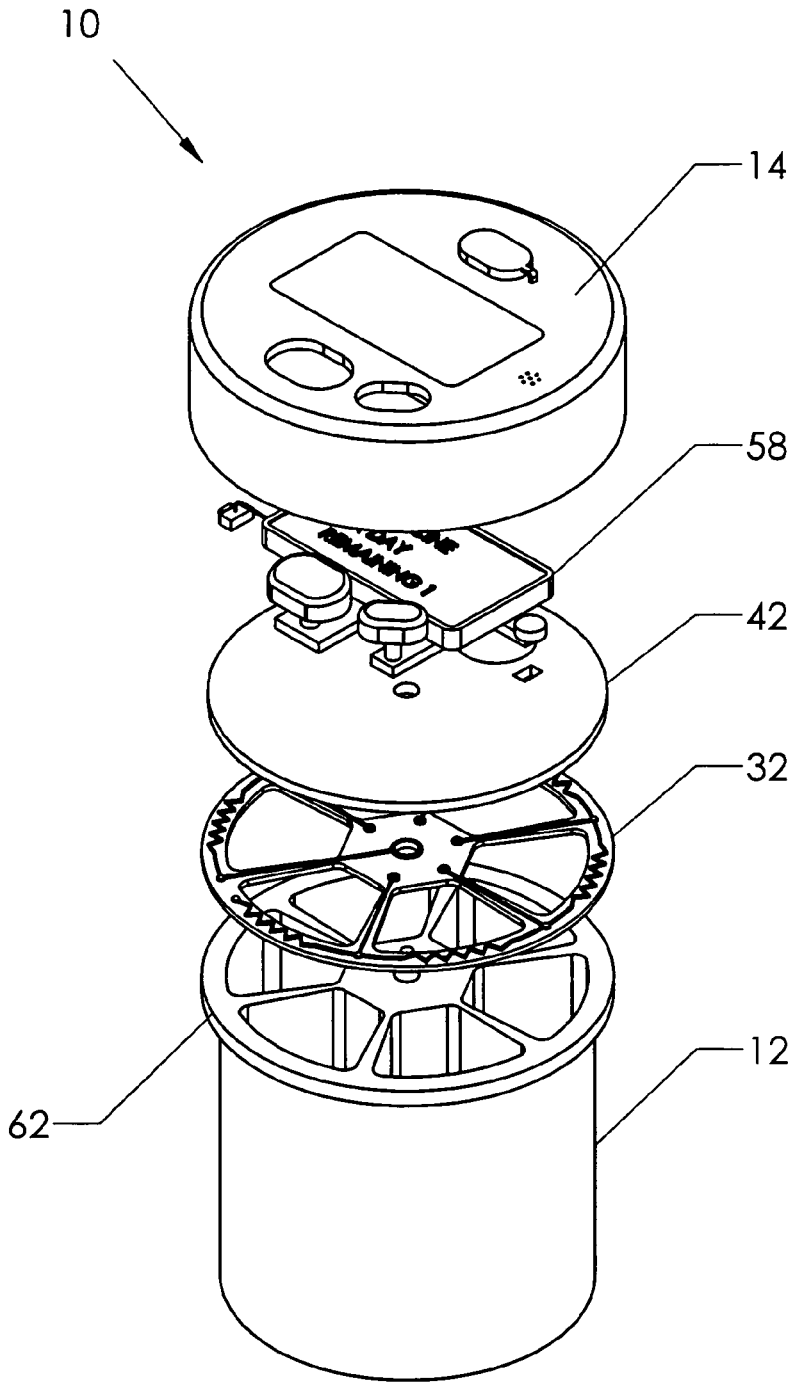
FIG. 10 is an exploded perspective view, illustrating components of the present invention.
Figure 11:
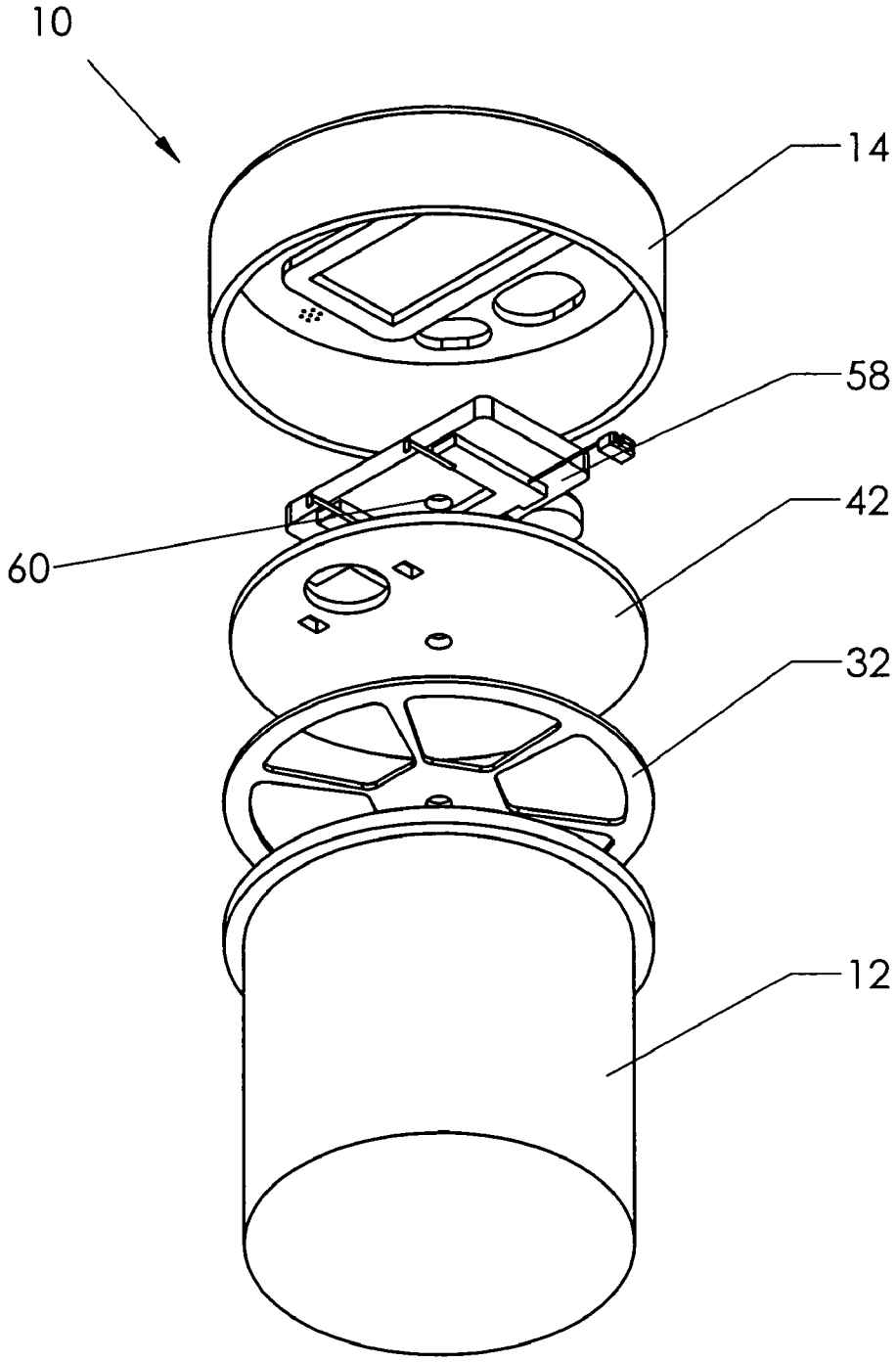
FIG. 11 is an exploded perspective view, illustrating components of the present invention.

FIGS. 10 and 11 illustrate dispensing container 10 in exploded states. The reader will appreciate that dispensing container 10 is generally formed by stacking and attaching together lid 14, display unit 58, pivot wafer 42, embedded circuit 32 and bottle 12. Pivot wafer 42, display unit 58, and lid 14 together form a "lid assembly" and rotate in unison about the grounding pivot on top of embedded circuit 32 and bottle 12. Various fasteners may be used to attach the lid assembly to bottle 12 in such a manner that the lid assembly is free to rotate relative to bottle 12. For example, lid 14 may include snap tabs which clamp lid 14 to flange 62.

Turning to FIG. 11, the reader will note that ground contact 60 is provided on the back of display unit 58. This provides a contact surface for grounding pivot 30 which is electrically connected to ground 38 of embedded circuit 32.

With the various components of the present invention now described, the reader will appreciate how the present invention works to dispense and track dosages of multiple medications over time. As mentioned previously, the programmable computing device is programmed to know the dosage schedule for each medication contained within each compartment of the container. The dosage schedule may be input through data port 24 or by a programming sub-routine accessible by pressing buttons 16 and 18 in a defined sequence. Programming via data port 24 may be performed by a pharmacist when filling the user's prescription or may be performed by the user using a separate computing device. In the latter example, software may be provided with dispensing container 10 for loading onto the user's personal computer. An easy-to-use interface may be provided for the user to manually enter his or her medication and dosage information, including the dosage schedule.

To dispense medication, the user simply turns lid 14 to align opening 26 with a selected medication. Display 20 will inform the user which medication opening 26 is presently addressing and how many dosages are remaining for the day. When the user dispenses a dosage, the user presses button 16 or 18. The programmable computing device has an integrated timer and tracks when the user inputs that a dosage was administered. Because the lid position detection device identifies which compartment the opening in the lid is presently addressing when the user presses the button, the programmable computing device knows which medication was dispensed and is able to track dosages administered from each compartment.

The medication dispensing container is thus able to be configured to perform various notification functions. For example, the dispensing container may emit an audible alarm or provide a visual notification when it is time to administer a particular medication. The medication dispensing container may also display information regarding when and how many previous dosages were administered and how many dosages are remaining for the day or when a prescription needs to be refilled.

The preceding description contains significant detail regarding the novel aspects of the present invention. It should not be construed, however, as limiting the scope of the invention but rather as providing illustrations of the preferred embodiments of the invention. Thus, the scope of the invention should be fixed by the following claims, rather than by the examples given.

Having described our invention, we claim:

1. A pill dispenser comprising:

a. a container having a plurality of compartments, each of said plurality of compartments configured to contain a plurality of dosages of one of a plurality of medications to be dispensed over a period of time of at least one week, said container having a top and a bottom, each of said plurality of compartments extending from said bottom of said container to said top of said container each of said plurality of compartments having an opening proximal said top of said container;

b. a user-rotatable lid attached to said container proximal said top of said container, said lid having an opening, said lid configured to rotate angularly about said container such that said opening in said lid may be selectively positioned in fluid communication with each of said plurality of compartments;

c. a lid position detection device configured to identify which of said plurality of compartments said opening is in a present state of fluid communication therewith;

d. a programmable computing device configured to track dosages administered from each of said plurality of compartments;

e. a display controlled by said programmable computing device; and f. wherein said programmable computing device is configured to display dosage information on said display regarding a medication contained within a selected compartment of said plurality of compartments, said selected compartment determined by the position of said opening as indicated by said lid position detection device;

g. wherein said lid position detection device comprises:

h. a rheostat, affixed to said top of said container;

i. wherein said rheostat includes a ground and a plurality of terminals, with each terminal having a unique electrical resistance between said terminal and said ground;

j. wherein said lid includes a first contact which is electrically connected to said ground in said rheostat;

k. wherein said lid includes a second contact configured to selectively contact each of said plurality of terminals within said rheostat as said user-rotatable, lid is rotated;

l. wherein said programmable computing device receives information regarding a resistance between said first and second contacts; and m. wherein said programmable computing device contains information allowing said programmable computing device to determine a position of said lid with respect to said container according to said information regarding a resistance between said first and second contacts.

2. The pill dispenser of claim 1, wherein said dosage information includes a name of said medication.

3. The pill dispenser of claim 1, wherein said dosage information comprises information regarding how often said medication should be administered.

4. The pill dispenser of claim 1, wherein said dosage information comprises information regarding how many dosages of said medication remain for the day.

5. The pill dispenser of claim 1, wherein said rheostat comprises an embedded circuit, said embedded circuit remaining stationary relative to said container when said lid is rotated angularly.

6. The pill dispenser of claim 1, further comprising an input device electrically connected to said programmable computing device, said programmable computing device configured to register that a dosage has been dispensed when said input device transmits an input to said programmable computing device.

7. A pill dispenser comprising:

a. a container having a plurality of compartments, each of said plurality of compartments configured to contain a plurality of dosages of one of a plurality of medications to be dispensed over a period of time, said container having a top and a bottom, each of said plurality of compartments extending from said bottom of said container to said top of said container; each of said plurality of compartments having an opening proximal said top of said container;

b. a user-rotatable lid attached to said container proximal said top of said container, said lid having an opening, said lid configured to rotate freely with respect to said container such that said opening in said lid may be selectively positioned by a user in fluid communication with each of said plurality of compartments;

c. a lid position detection device configured to identify which of said plurality of compartments said opening is in a present state of fluid communication therewith, said lid position detection device comprising a rheostat; and d. a programmable computing device configured to track dosages administered from each of said plurality of compartments.

8. The pill dispenser of claim 7, further comprising:

a. a display controlled by said programmable computing device; and b. wherein said programmable computing device is configured to display dosage information on said display regarding a medication contained within a selected compartment of said plurality of compartments, said selected compartment determined by the position of said opening as indicated by said lid position detection device.

9. The pill dispenser of claim 8, wherein said dosage information includes a name of said medication.

10. The pill dispenser of claim 8, wherein said dosage information comprises information regarding how often said medication should be administered.

11. The pill dispenser of claim 8, wherein said dosage information comprises information regarding how many dosages of said medication remain for the day.

12. The pill dispenser of claim 7, wherein said lid position detection device comprises:

a. an embedded circuit, including said rheostat, said embedded circuit remaining stationary relative to said container when said lid is rotated angularly;

b. wherein said rheostat includes a ground and a plurality of terminals, with each terminal having a unique electrical resistance between said terminal and said ground;

c. wherein said lid includes a first contact which is electrically connected to said ground in said rheostat, d. wherein said lid includes a second contact configured to selectively contact each of said plurality of terminals within said rheostat as said user-rotatable lid is rotated;

e. wherein said programmable computing device receives information regarding a resistance between said first and second contacts; and f. wherein said programmable computing device contains information allowing said programmable computing device to determine a position of said lid with respect to said container according to said information regarding a resistance between said first and second contacts.

13. The pill dispenser of claim 7, further comprising an input device electrically connected to said programmable computing device, said programmable computing device configured to register that a dosage has been dispensed when said input device transmits an input to said programmable computing device.

14. A pill dispenser comprising:

a. a container having a plurality of compartments, each of said plurality of compartments configured to contain a plurality of dosages of one of a plurality of medications to be dispensed over a period of time, said container having a top and a bottom, each of said plurality of compartments extending from said bottom of said container to said top of said container, each of said plurality of compartments having an opening proximal said top of said container;

b. a user-rotatable lid attached to said container proximal said top of said container, said lid having an opening, said lid configured to rotate freely with respect to said container about an axis of rotation such that said opening in said lid may be selectively positioned in fluid communication with each of said plurality of compartments;

c. a lid position detection device configured to identify which of said plurality of compartments said opening is in a present state of fluid communication therewith, said lid position detection device including a grounding pivot, said grounding pivot lying in said axis of rotation of said lid, wherein said lid position detection device comprises a rheostat; and d. a programmable computing device configured to track dosages administered from each of said plurality of compartments, said programmable computing device electrically connected to said grounding pivot.

15. The pill dispenser of claim 14, further comprising:

a. a display controlled by said programmable computing device; and b. wherein said programmable computing device is configured to display dosage information on said display regarding a medication contained within a selected compartment of said plurality of compartments, said selected compartment determined by the position of said opening as indicated by said lid position detection device.

16. The pill dispenser of claim 14, wherein said lid position detection device comprises an embedded circuit, said embedded circuit remaining stationary relative to said container when said lid is rotated angularly.

17. The pill dispenser of claim 14, further comprising an input device electrically connected to said programmable computing device, said programmable computing device configured to register that a dosage has been dispensed when said input device transmits an input to said programmable computing device.

* * * * *